US005465789A

United States Patent [19]

Evans

[11] Patent Number: 5,465,789

[45] **Date of Patent: * Nov. 14, 1995**

[54] APPARATUS AND METHOD OF MAGNETIC WELL STIMULATION

[76] Inventor: James O. Evans, P.O. Box 876, Pampa, Tex. 79066-0876

[ * ] Notice: The portion of the term of this patent subsequent to Jun. 28, 2011, has been disclaimed.

[21] Appl. No.: 250,929

[22] Filed: May 31, 1994

Related U.S. Application Data

[63] Continuation-in-part of Ser. No. 19,155, Feb. 17, 1993, Pat. No. 5,323,855.

[51] Int. Cl.[6] ..... E21B 43/24

[52] U.S. Cl. ..... 166/248; 166/66.5

[58] Field of Search ..... 166/248, 304, 166/65.1, 66.5

[56] References Cited

U.S. PATENT DOCUMENTS

| | | | |
|---|---|---|---|
| 849,524 | 4/1907 | Baker . | |
| 2,472,445 | 6/1949 | Sprong . | |
| 4,046,194 | 9/1977 | Cloud . | |
| 4,373,581 | 2/1983 | Toeliner . | |
| 4,466,484 | 8/1984 | Kermabon . | |
| 4,495,990 | 1/1985 | Titus . | |
| 4,538,682 | 9/1985 | McManus . | |
| 4,579,173 | 4/1986 | Rosensweig . | |
| 4,630,862 | 1/1987 | Savage . | |
| 4,716,960 | 1/1988 | Eastlund . | |
| 4,926,941 | 5/1990 | Glandt . | |
| 5,065,819 | 11/1991 | Kasevich . | |
| 5,323,855 | 6/1994 | Evans | 166/248 |

FOREIGN PATENT DOCUMENTS

| | | |
|---|---|---|
| 2938-998 | 1/1981 | Germany . |

*Primary Examiner*—William P. Neuder
*Attorney, Agent, or Firm*—Head & Johnson

[57] ABSTRACT

A method and apparatus for subjecting subterranean, fluid-bearing formations to magnetic flux forces. Magnetically susceptible fluids and magnetically susceptible particles are extracted from a subterranean well having a shaft or tube extending from the surface into a fluid containing formation and with an elongated rod within the shaft or tube.

10 Claims, 4 Drawing Sheets

APPARATUS AND METHOD OF MAGNETIC WELL STIMULATION

This is a continuation-in-part application Ser. No. 08/019,155, filed Feb. 17, 1993, now U.S. Pat. No. 5,323, 855, entitled "WELL STIMULATION PROCESS AND APPARATUS" which is incorporated herein by reference.

BACKGROUND OF THE INVENTION

1. Field of the Invention

The present invention induces electric current in coils located down the bore hole of a well, by means of permanent magnets which are caused to move up and down through these coils by means of the mechanical energy of the moving rod string, which energy is supplied by the moving production pump plunger, or by the moving rotor or stator, or a pump. The coils, electrically energized in this manner, become electromagnets, thereby increasing flow of fluids.

2. Prior Art

Induced Electromotive Force

The development of commercial electric power and technology started over 100 years ago with the discovery of the principle of the electrically-induced magnetic field. After Oersted and others had shown that magnetism was associated with and could be produced by electricity, many scientists started to look for the reverse effect—the production of electricity from magnetism. Michael Faraday initiated a series of experiments which culminated in the discovery of electromagnetic induction. In the United States, the scientist Joseph Henry (1797–1878), independently discovered the induction or generator principle.

In one of the most basic of Faraday's experiments, he connected a coil directly to a current meter and pushed a permanent bar magnet into and out of the coil. He found that a momentary current was registered on the meter, whenever he moved one pole of the magnet quickly toward the coil. When he pulled the magnet away from the coil, there was again a brief current registered but this time in the opposite direction, as registered by the reverse meter deflection. No current was observed as long as the magnet and the coil were held still in any position.

Principle of Induced Voltage

A stationary magnetic charge exists surrounded by a constant or stationary dielectric field. The energy present in this field is a form of potential energy. When a magnet moves, its dielectric field moves with it. Motion of the dielectric field can cause some of its energy to be converted from potential energy to energy of motion or magnetic energy.

Varying the speed of motion of the dielectric field (varying the current) results in varying the strength of the magnetic field. The strength of the magnetic field increases and decreases. The magnetic field is "in motion".

If a coil is located in a magnetic field of varying strength (a moving magnetic field), in order to preserve the energy balance in the system, the potential energy of the dielectric field must also change in strength.

An induced voltage is produced across a coil when it is located in a varying magnetic field. The direction in which the electrons (current) move depends on the direction in which the lines of force of the magnetic field are moving. The polarity of the induced voltage therefore also depends on the direction in which the magnetic field is moving.

As a magnet is pushed down through a coil, a reaction is produced in the coil, which tries to oppose this motion. Since the magnetic-field strength around the coil is changing, a voltage is induced across the coil. The free electrons in the winding are pushed or pulled to one end. This constitutes a current flow through the coil. When current flows in a coil, the coil becomes an electromagnet with its own north and south poles. In order to oppose the motion of the permanent magnet, the top of the coil becomes a north pole.

If the motion of the magnet is stopped, the magnetic field becomes stationary. The dielectric field also becomes steady. The electrons in the coil redistribute themselves evenly and the induced voltage is gone.

As the magnet is withdrawn, the magnetic field is moving in the opposite direction. The top of the coil becomes a south pole and tries to hold the permanent magnet and prevent it from being pulled out. Again the reaction is opposite to the action.

Mechanical energy can be used to move the permanent magnet against the reaction. This energy is converted to electrical energy which appears as the induced voltage. Lenz's law states this effect as, "In all cases of electromagnetic induction, the induced currents have such a direction that their reaction tends to stop the motion which produces them". The direction of the motion of the electrons in the coil was such as to produce a magnetic field that tends to stop the motion of the magnet producing the action.

In induced voltages, the voltage produced must depend on the work done in cutting the lines of force. The induced voltage is therefore dependent on three factors:

1. Number of turns in the generating coil. Each turn may be considered as two conductors in series. Work must be done to make the magnetic lines cut each conductor. The amount of work increases as more turns are used, and the voltage increases directly with the number of turns. Since the turns are in series, these small voltages are additive. The more turns, the greater the total voltage.

2. The strength of the magnetic field. The stronger the field, the greater are the number of lines of force emanating from the coil. More magnetic lines of force will cut a conductor; the permanent magnets are spaces so as to move by and cut the maximum number of turns of the coils. More work must be done to accomplish this result, and hence more voltage will be generated.

3. The relative speed of motion between generating coil and magnetic field. When a coil is in a moving magnetic field, more work must be done in a given time to make the cutting of the lines of force faster. Therefore, coils of the greatest possible diameter, shortest length, and finest wire and the number and spacing of powerful permanent magnets will result in the highest voltage.

To produce a strong magnetic field, electromagnets are often wound on iron cores. When the current in an electromagnet coil is changing, the magnetic field is either expanding or contracting, and as the flux cuts the turns of the coil, a voltage is induced in the winding.

Self-Inductance and Mutual Inductance

The ability of a circuit to develop an induced voltage when the current flowing through the circuit is changing is called self-inductance. A coil having this property is called an inductance or an inductor.

When an inductive circuit is opened, as from permanent magnets moving by coils, the instant value of the induced voltage will be high. At the instant the circuit is opened, as when the magnet leaves the coil, the current tends to drop from its full value to zero. This is the highest rate of change of current, and the induced electromotive force, EMF, is at its maximum valve.

The coil have self-inductance because they have the ability to develop and induced voltage in their own windings as a result of their own flux. With two or more coils, the flux from each coil has the ability to develop an induced voltage in the other coil's winding. This effect is known as mutual inductance.

Two or more coils can be connected in series to an induced voltage, and the coils can be so located that there is mutual inductance between them. Also, these coils can be so connected that the flux from each coil at any instant is in the same direction (aiding).

SUMMARY OF THE INVENTION

This invention comprises an apparatus and method for aiding the extraction of hydrocarbon oil or other fluids which are trapped in subterranean reservoirs by subjecting these fluids to intermittent magnetic flux forces by means of electromagnetically-charged wire coils, and withdrawing the fluids through a wellbore hole.

In the apparatus, wire coils are positioned in the wellbore hole. Magnetic flux forces result from electricity flowing through the coils. This electricity is generated by passing powerful permanent magnets through the coils. The magnetic forces thereby generated attract magnetically susceptible particles which are present in most subterranean hydrocarbon reservoir fluids and fluid containing formations, thereby causing these particles to migrate to the wellbore. As the particles move to the wellbore, they pull the reservoir fluids along with them. The fluids, upon reaching the wellbore, can then be pumped to the surface.

A novel result of this invention is realized because the magnetic fields which radiate from the wellbore coils are made to alternate between positive and negative. Magnetically-susceptible particles in the fluid surrounding the wellbore are first exposed to a flux or charge of one magnetic sign (wither positive or negative), followed by immediately exposing the particles to a flux (or charge) of the opposite sign, (in this case either negative or positive). This results in the particles moving with a series of stops and starts or jerky motion towards the wellbore, thereby stimulating flow of fluid to the wellbore, by pushing and pulling the entrapped liquids (located in the pores of the formation) toward the wellbore.

This start and stop or jerky motion of the particles which are contained in the formation fluid, in combination with suction force which is created by the wellbore pump, and/or pressure resulting from gases in the formation, causes increased flow of formation fluids to the wellbore.

The magnetic fields which alternate between positive and negative in my apparatus, result from up and down motion of powerful permanent magnets fixed on a central shaft or rod in the wellbore. This central shaft is a pump plunger, and its up and down motion moves formation fluids to a borehole downhole pump which pumps the formation fluids to the surface where the fluids are recovered. As these magnets move up and down they pass through the centers of wire coils located in the wellbore, causing electric currents to pass through these coils. This electric current causes the coils to act as electromagnets, which then attract magnetically susceptible particles to the wellbore. When the direction of motion of the electromagnet-bearing shaft changes from up to down (or from down to up), these magnets pass through the coils in a different direction, which causes the flow of electricity in the coils to change direction. The part of the coils from which previously radiated negative magnetic flux then radiates positive electromagnetic flux, or vice versa.

In this manner, each time a magnet on the shaft changes direction and passes through the coils, the magnetic flux radiating from the coils changes sign.

This apparatus and invention will cause fluid flows to increase and will enable hydrocarbons or other fluids to be extracted from subterranean formations which were considered to be "spent" or no longer capable of fluid extraction by conventional means.

In one variation of this invention, a vibration-sensitive material having piezoelectric properties is inserted into the electrical circuit in order to cause the vibrations and pressure of the oil well pump to induce some electricity which will aid the electric current to power the electromagnets.

In another variation, a capacitor, converter, transformer, motor or battery are inserted in the electrical circuit to provide bursts of increased electricity to the electromagnets.

The apparatus may also be used to generate electrical energy for other down-hole applications.

DETAILED DESCRIPTION OF THE PREFERRED EMBODIMENTS

The present invention describes an apparatus and process to aid in the extraction of hydrocarbons such as oil 10 or other fluids which are trapped in subterranean formations or reservoirs.

Figure 1:
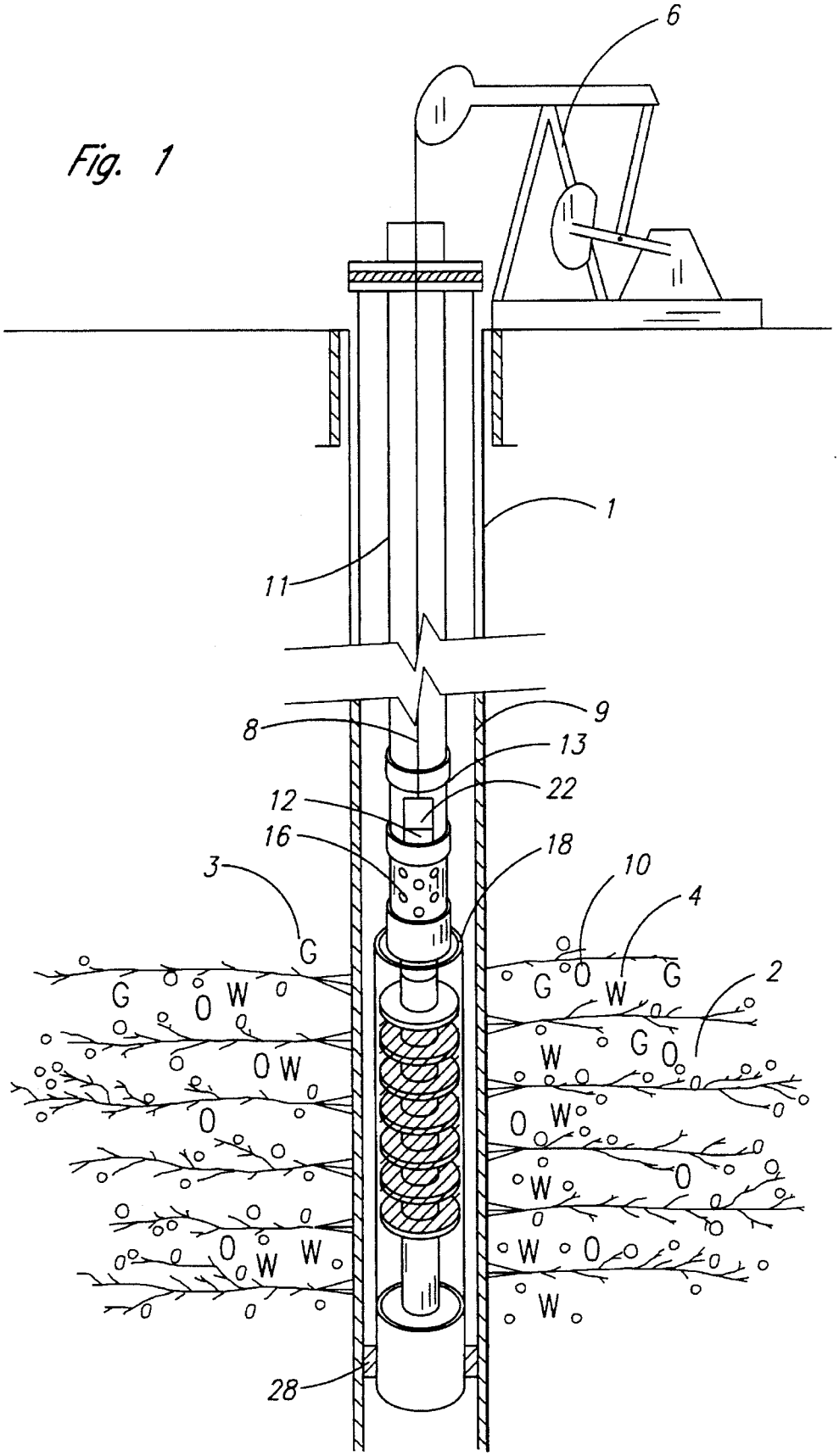
FIG. 1 is a sectional and schematic view of a wellbore, well equipment, and the coils and permanent magnet apparatus which induces an electric current in these coils constructed in accordance with the present invention.

Referring to FIG. 1, a wellbore 1 is drilled into a fluid-containing formation such as payzone 2, which contains oil 10 and/or natural gas 3. Metal surface casing may be installed near the surface. Metal casing 9 is cemented into the wellbore 1 in order to maintain the integrity of the wellbore. Pumping unit 6 tubing 11, rod 8, and top hold-down pump 12 may be used to move fluid to the surface in conventional manner. Natural gas 3 and oil 10 in payzone 2 are located in fissures in the subterranean formation.

Initially, a reservoir has a certain amount of potential energy in the form of pressurized fluids and gas. This potential energy is depleted as fluids and gas 3 move to the wellbore 1 and exit the formation until eventually insufficient pressure remains causing oil 10 flow (oil production)

to drop below economic levels. As the reservoir pressure decreases, fluid surface tension also changes.

In the period following the drilling of an oil well, certain factors occur which result in the amount of oil 10 which is extracted from the well to decrease. Oil production may eventually decrease to a point where it is uneconomical to continue well operation. It is generally believed that about 60 percent of the hydrocarbon fluid 10 originally located in payzone 2 is not easily recovered. Formation water 4 may move into the pores and fractures, thereby preventing the oil from exiting the payzone 2. Solids may also enter the pores and fractures and block the oil 10 from leaving the payzone 2.

Figure 2:
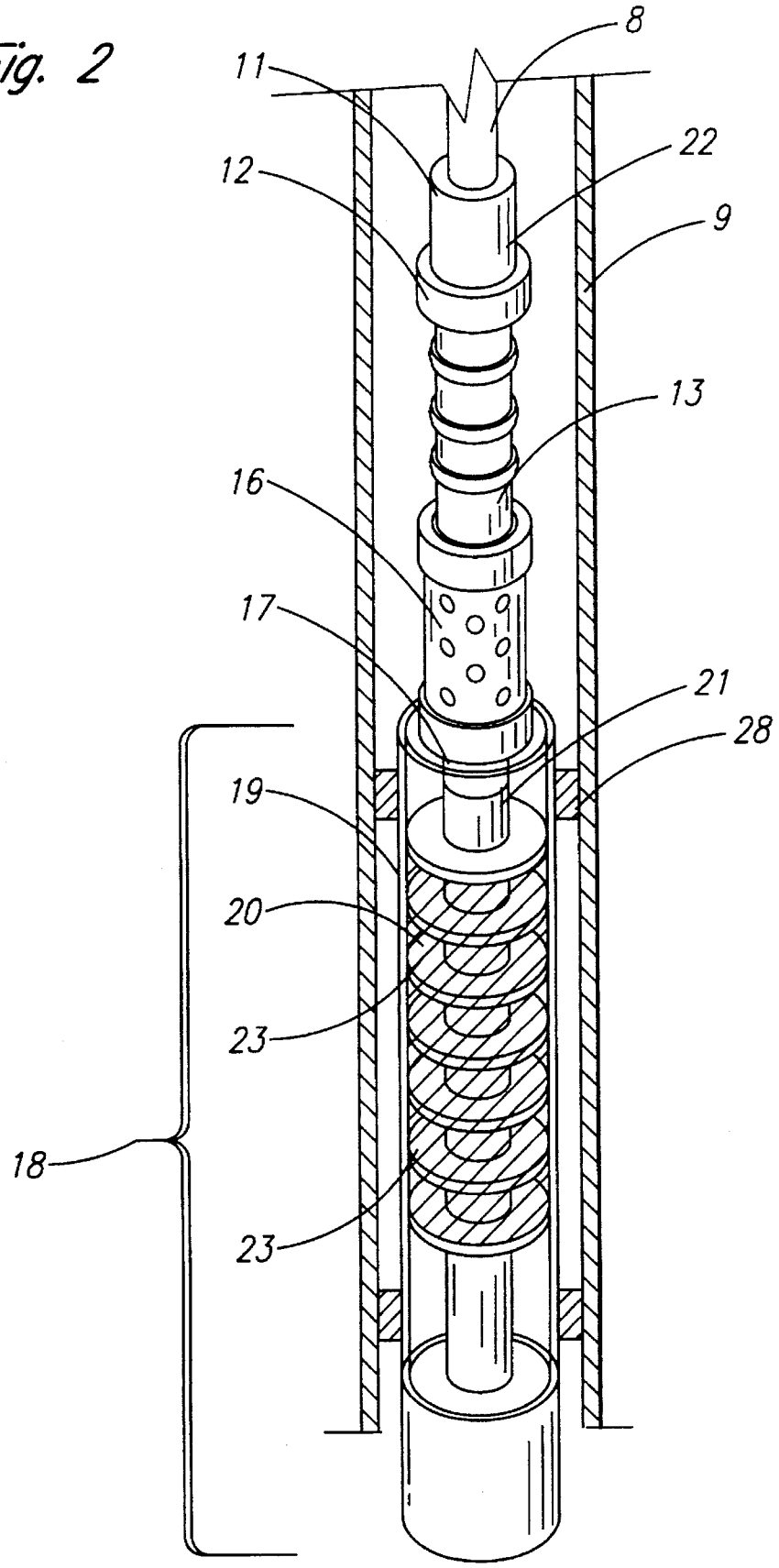
FIG. 2 is an enlarged view of one preferred version of the apparatus whereby electric current is induced in stationary coils by moving permanent magnets inside of these coils thereby changing them to the electromagnetic coils of the present invention.

Referring now to FIG. 2, electromagnetic apparatus 18 with coils 23 installed in a wellbore, when energized with electricity, will attract magnetically susceptible particles in the reservoir and cause them to move toward the wellbore, bringing along with these particles hydrocarbon fluids 10.

If the apparatus 18 is installed in a new well, the benefits of this process will prevent many of the deleterious effects on the oil-bearing formation or payzone 2, and oil 10 flow will be prevented from decreasing as much as in the usual case. The present invention may also be used in existing wells.

Oil 10 and gas 3 occupy the smallest portion of the reservoir's pore structure; the main component is formation water 4. Formation water 4 contains very large amounts of magnetically susceptible solids; the amount of these solids increases as the age and depth of the formation increases.

Reservoirs contain an intimate mixture of colloidal solids, metals, clays, shales, oil 10 and formation water 4. Each of these components has varying magnetic susceptibilities, and will react differently to magnetic flux.

Referring to FIG. 2, it has been found that electrical energy applied to one or more coils 23 having metal cores, placed in a wellbore 1, which is in the payzone (a liquid hydrocarbon bearing formation), will cause the flow of fluids to the wellbore to increase.

The magnetic flux of the electromagnetic coil will cause fluid flow to increase when the natural forces of formation water 4 displacement of the oil 10 cease to be effective.

A pulsating magnetic field, such as can emanate from coil 23, is an effective method for causing magnetically susceptible particles to move towards the wellbore, thereby increasing flow of fluids. An even more effective result is obtained if the direction of flow of the electric current in coils 23 is periodically reversed, thereby alternating the sign of the magnetic flux fields emanating from coils 23 to switch from positive to negative or vice versa.

Figure 3:
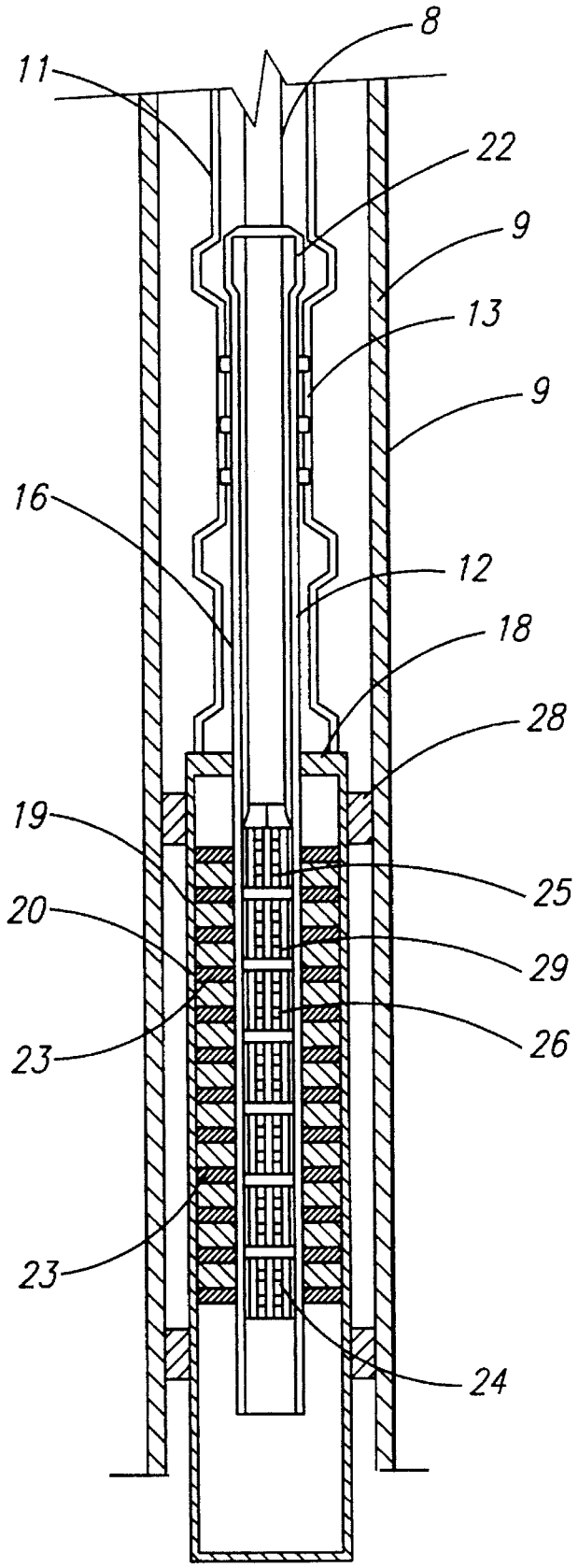
FIG. 3 is an enlarged view of one preferred version of the apparatus coil design showing the shaft-mounted permanent magnets which generate the electromagnetic coils of the present invention.

As seen in FIG. 3, both pulsating and reversing magnetic flux fields emanate from the wellbore, and act upon the fluid bearing subterranean formation, thereby increasing flows of fluid.

In one preferred embodiment of my invention, central rod or pump plunger 24 is shown in FIG. 3, to which are attached powerful circular permanent magnets 25, pumping rings 29, and pole pieces 26. The pumping rings constitute rubber seals.

In another embodiment of my invention, shown in FIG. 1, electrically energized coils 23 may be substituted for the permanent magnets 25.

The rod 8 or pump plunger 24 oscillates up and down in the wellbore. Surrounding the inner shell 21 of the apparatus and spaced along the apparatus wall 18 are coils 23. Rod (pump plunger) 24 oscillates up and down, thereby pulling the fluid located in the inner shell 21 to the bottom of the top hold-down pump 12 and outer shell 19 up into tubing 11, and then to the surface.

When permanent magnets 25 oscillate up and down in the centers of coils 23, electric current flows through coils 23. The Coils 23 thus, become electromagnets. The direction of current flow changes every time that the permanent magnets 25 move up through the coils, and every time the magnets 25 move down through the coils.

Figure 4:
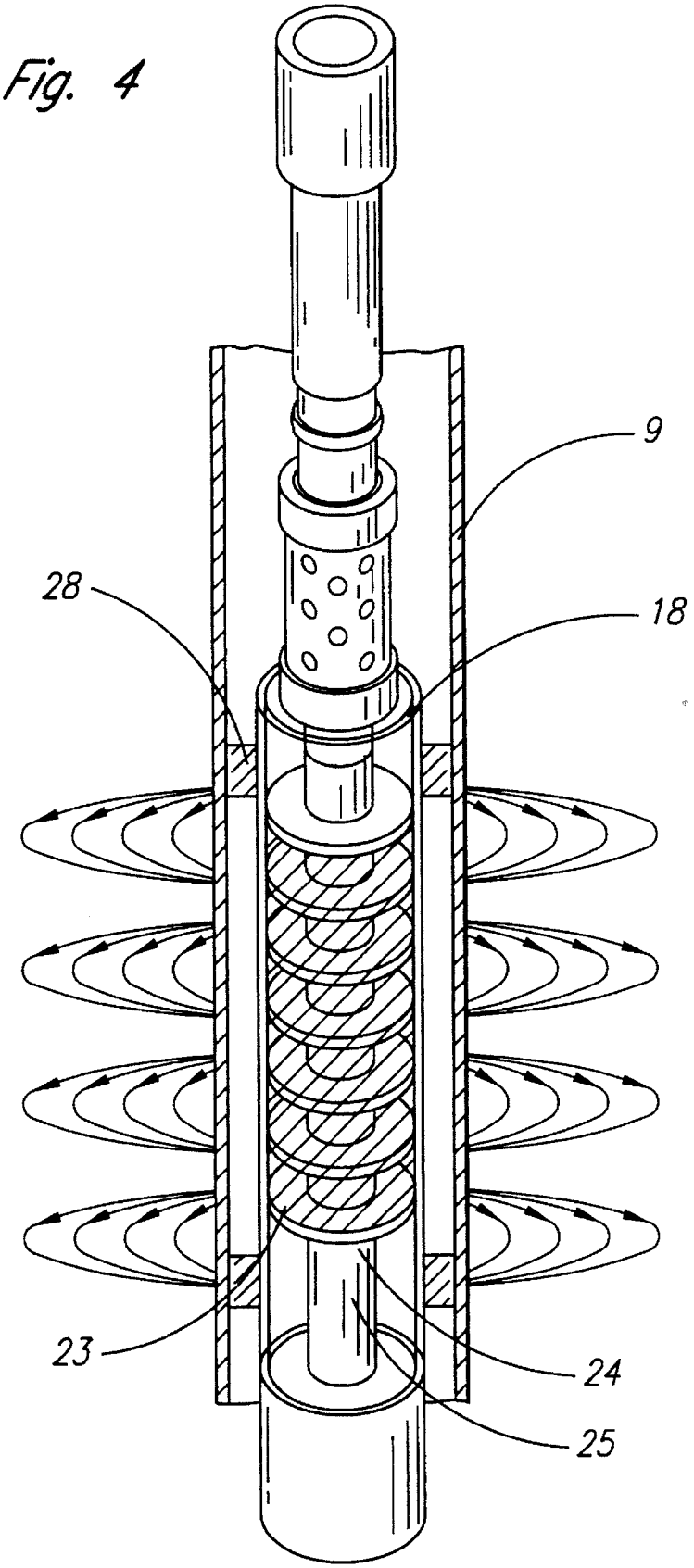
FIG. 4 illustrates the magnetic field emanating from the apparatus.

Referring to FIG. 4 the coils 23 become electromagnets when electric current flows through them, and north and south magnetic fields are created emanating from the coils. When the direction of movement of the magnets changes, north and south poles are reversed.

The operation and installation of the apparatus is as follows:

Apparatus 18 is installed below the perforated nipple 16 at the bottom end of the seating nipple 13 which is installed on the bottom of the production tubing 11, as shown in FIG. 2.

The top hold-down pump 12 is installed in the seating nipple 13. As tubing 11 is made-up on the surface, non-magnetic spacers 28 are placed on the outside of the apparatus 18 as it lowered into the wellbore to keep the apparatus 18 centered in the casing 9. The bottom of the coupler, a unit to attach the moving pumping rods 8 to the production pump 12, is attached to the top of the production pump 12, which is inserted through the seating nipple and perforated nipple into the inner shell 21 of the apparatus 18.

The tubing 11, attached to the seating nipple 13, is assembled and lowered into the wellbore casing 9 and set at a predetermined depth in the well's payzone. The apparatus, with production pump, is assembled on the surface in order to prevent the magnetic attraction between permanent magnets in the pump and the tubing if the pump were lowered on the rods 8 after the tubing is installed. The weight of the tubing 11 will force the apparatus 18, with the pump 12 and permanent magnets inside, down through the casing 9.

The top of the coupler 22 is attached to the bottom of the pumping rods 8 which have been lowered into the tubing 11 of the well. The top of the coupler 22 on the rods 8 is coupled with the bottom of the coupler 22 which was attached to the top of the production pump 12.

As the well pumping motion begins, the permanent magnets 25, which are placed on the ring-type pump plunger 24, with pole pieces 26 and pumping rings 29 with efficiently designed spacing, begin to move through the coils. The moving permanent magnets 25 and the coils 23 are placed with like magnetic poles together. The pole pieces on the coils 20 and on the pump plunger 26 are placed between like magnet poles to direct the magnetic field at a 90° angle to the wellbore, shown in FIG. 3 and FIG. 4. As the permanent magnets 25 on the pump plunger 24 move, induced electric current is created in the coils 23. The coils 23 become electromagnetic coils and will extend the magnetic flux into the formation fluids in the payzone 2. The coils 23 in the apparatus 18 are stationary at the bottom end of the tubing.

The strength of the electromagnet depends upon the current induced in the coil. As the strength of the field increases, the lines of force extend out and "cut" the turns of the generating coil 23. A current is induced in the generating coil 23.

At the top of the pumping stroke, the magnetic field collapses and the current decreased to zero. As the lines of force collapse, the highest rate of change of current occurs and the induced EMF is at its maximum valve. Again a voltage is induced in the generating coil 23.

As the permanent magnet 25 moves downward on the pumping stroke, the current builds up again, but this time it flows in the opposite direction. Again, the magnetic field strength increases. The action is similar to the upward motion but with different polarity.

At the bottom of the stroke, this current in turn reduces to zero. The magnetic field again collapses. This action is similar to the upward motion but with different polarity.

As each pole piece 26 of the pump plunger 24 crosses each coil 23, an electric current is induced in the circuit.

The formation fluids, as they are pulled to the wellbore, will enter the perforated nipple 16, travel down the inner shell 21 of the apparatus 18 and enter the bottom of the production pump 12 and be transported up the tubing 11 to the surface. The apparatus 18 being placed below the perforated nipple 16 will remain in fluid and not be heated.

The preferred embodiment apparatus 18 is described with a top hold-down pump 12. Any pump, however, with a moving plunger 24 or barrel 17 with permanent magnets 25 in the moving section may be used with the apparatus 18. Permanent magnets 25 and coils 23 will be arranged for a rotating pump.

The apparatus 18 with coils 23 and moving permanent magnets 25 can be used for this and other downhole electrical applications.

A specific best mode process and apparatus has been described and illustrated for this invention in this preferred embodiment, but it is to be understood that the same may be varied with the scope of the appended claim without departing from the spirit of the invention.

Whereas, the present invention has been described in relation to the drawings attached hereto, it should be understood that other and further modifications, apart from those shown or suggested herein, may be made within the spirit and scope of this invention.

What is claimed is:

1. An apparatus to extract magnetically susceptible fluids and magnetically susceptible particles from a subterranean well having a shaft or tube extending from the surface into a fluid containing formation and an elongated rod within said shaft or tube, which apparatus comprises:

at least one permanent magnet attached to said rod;

at least one stationary coil within said well;

means to reciprocate said rod to reciprocate said permanent magnet in relation to said coil in order to induce electric current in said coil; and means to attract and repel said magnetically susceptible fluids and magnetically susceptible particles by production of intermittently reversing magnetic flux.

2. An apparatus as set forth in claim 1 including a plurality of said permanent magnets axially aligned with said rod.

3. An apparatus as set forth in claim 2 wherein like poles of adjacent magnets face each other.

4. An apparatus as set forth in claim 2 including pumping ring seals interspaced between said permanent magnets.

5. An apparatus as set forth in claim 1 including a plurality of said stationary coils.

6. An apparatus as set forth in claim 5 wherein said coils are wound around an inner shell of a subterranean pump.

7. A process to extract magnetically susceptible fluids and magnetically susceptible particles from a subterranean well having a shaft or tube extending from the surface to a fluid-containing formation and a rod extending within said shaft or tube, said process comprising:

attaching at least one permanent magnet to said rod within said well;

installing at least one stationary coil within said well;

reciprocating said rod in order to reciprocate said permanent magnet to induce electric current in said coil; and producing intermittently reversing magnetic flux in order to attract and repel said magnetically susceptible fluids and magnetically susceptible particles.

8. A process as set forth in claim 7 wherein a plurality of said magnets are attached to said rod.

9. A process as set forth in claim 8 wherein like poles of adjacent magnets face each other.

10. A process as set forth in claim 8 wherein pumping ring seals are interspaced between said permanent magnets.

* * * * *